US005146043A

United States Patent [19]

Means et al.

[11] Patent Number: 5,146,043

[45] Date of Patent: Sep. 8, 1992

[54] BULLET EXTRACTOR

[76] Inventors: Jeffrey Means, R.D. 5, Box 291; Robert A. Haag, Jr., R.D. 5, Box 300; Richard D. Steffy, 708 Pine St., all of Punxsutawney, Pa. 15767

[21] Appl. No.: 636,506

[22] Filed: Dec. 31, 1990

[51] Int. Cl.[5] ..... F42B 33/00; F42B 33/02; F42B 35/02

[52] U.S. Cl. ..... 86/24; 86/23; 86/28; 86/44; 86/49

[58] Field of Search ..... 86/24, 44, 46, 49, 43, 86/23, 25, 28, 29, 31, 33, 37, 1.1

[56] References Cited

U.S. PATENT DOCUMENTS

| | | | |
|---|---|---|---|
| 234,259 | 12/1880 | Farnham | 86/44 |
| 339,396 | 4/1886 | Fisher | 86/44 |
| 358,769 | 3/1887 | Boyd et al. | 86/24 |
| 378,400 | 2/1988 | Lyon | 86/24 |
| 1,031,221 | 7/1912 | Wilson | 86/43 |
| 2,449,059 | 9/1948 | Costello | 86/1.5 |
| 2,824,482 | 11/1953 | North | 86/1 |
| 2,970,508 | 9/1958 | Wicks | 86/23 |
| 3,123,369 | 3/1964 | Jacobsen | 279/35 |
| 3,185,019 | 9/1964 | Shoffstall | 86/44 |
| 3,646,661 | 3/1972 | Ashbrook | 29/275 |
| 3,813,987 | 6/1974 | Minneman | 86/44 |
| 3,896,699 | 7/1975 | Cerro | 86/44 |
| 3,898,908 | 8/1975 | Isenhower | 86/1 A |
| 4,005,630 | 2/1977 | Patrick | 86/1 A |
| 4,028,989 | 6/1977 | Vassallo | 86/1 A |
| 4,425,833 | 1/1984 | Purdie | 86/44 |

OTHER PUBLICATIONS

*Handloader's Digest*, 6th Edition, 1972.

*American Riflemen*, Jul. 1954.

"Safe and Practical Bullet Pulling", Norman E. Johnson, *American Rifleman* vol. 138, No. 2 Feb. 1990.

*Primary Examiner*—J. Woodrow Eldred

*Attorney, Agent, or Firm*—John M. Adams

[57] ABSTRACT

A bullet holder for extracting a bullet from the cartridge casing that includes an elongated body portion having arm members pivotally connected at one end and movable toward one another in a pincer-type movement. Intermediate the arm members is positioned a bullet retaining portion having a plurality of oppositely positioned recesses forming holes of selected diameter corresponding to selected bullet calibers. The assemblied cartridge casing and bullet is secured in the chuck of a loading press. The chuck is moved to an initial position for engaging the bullet by the holder in a selected one of the holes formed by the recesses. The arm members are squeezed to frictionally engage the bullet so upon downward movement of the cartridge casing, the bullet is retained stationarily positioned to separate the cartridge casing from the bullet.

13 Claims, 9 Drawing Sheets

BULLET EXTRACTOR

BACKGROUND OF THE INVENTION

1. Field of the Invention

This invention relates to a method and an apparatus for extracting a bullet from a cartridge casing, and more particularly, to a hand-held device used in combination with a loading press, to stationarily position the bullet as the cartridge casing is separated from the bullet.

2. Description of the Prior Art

It is a well-known practice among shooters and riflemen to disassemble a fire arm cartridge into its various components which include a bullet, a cartridge casing, and a charge of propellent powder. The cartridge is disassembled for various reasons. It may be desirable to reload the cartridge with a different type of bullet and to change the type of propellent powder as desired by the user. Once the cartridge is disassembled it is then reloaded to include the desired bullet and propellent powder in the cartridge.

There are many approaches and tools utilized to extract a bullet from a cartridge casing. One type of bullet puller is known as the inertia bullet puller, as disclosed in U.S. Pat. No. 3,646,661, in which the cartridge is positioned in the bore of a carrier tube and is securely gripped by a jaw or a cam-like mechanism. The cartridge is thus stationarily positioned so that when the opposite end of the carrier tube is impacted with a surface, the bullet is extracted from the cartridge by the inertia force, which exceeds the force exerted by the cartridge wall on the bullet. Another example of an inertia bullet puller is disclosed in U.S. Pat. No. 3,898,908, where the cartridge is securely locked in place by engagement with sliding plates to accommodate the diameter of the cartridge. In this manner, various cartridge calibers can be reloaded. Once the cartridge is securely held in place, a hammer-like head portion is struck on a solid object to separate the bullet from the cartridge casing, as above described with regard to U.S. Pat. No. 3,646,661. A further improvement to the known inertia-type bullet pullers is disclosed in U.S. Pat. No. 4,028,989, in which the bullet is propelled by air pressure through a tube to a point where the cartridge is obstructed from further advancement and is separated from the bullet which is propelled into contact with the plate.

U.S. Pat. Nos. 2,9790,508; 3,123,369; and 4,005,630 are examples of press-type devices that are securable to a table for extracting the bullet from the cartridge casing. In U.S. Pat. No. 2,970,508, a gripping device includes a plurality of spring fingers that firmly grip and hold the bullet. Then, a press handle is moved downwardly to move the cartridge with the bullet being retained fixed by the fingers. The fingers automatically tighten against the bullet so that further downward movement of the cartridge casing separates the cartridge casing from the bullet.

U.S. Pat. No. 3,123,369 discloses a bullet puller in which bullets of all calibers can be extracted from the cartridge casing without changing any parts of the puller. The puller includes pivotal jaws having curved surfaces which rotate to determine the size of the opening for receiving the bullet. Once the jaws engage the bullet, they are locked in place. The cartridge is then inserted in a press and a downward force is applied to the cartridge. The bullet is pulled from the cartridge because it resists the downward movement of the cartridge. This device permits a wide range of bullet calibers to be handled and permits a continuous feed of bullets for extraction.

A bullet press that includes a jaw-like device for engaging the bullet is also disclosed in U.S. Pat. No. 4,005,630. An upward force is applied to a handle connected to a chuck to separate the bullet from the cartridge casing. The force is exerted by the chuck on the bullet with an increase in the force exerted on the handle of the press. Further examples of extracting a bullet from a cartridge casing are disclosed in U.S. Pat. Nos. 2,824,482 and 2,449,059.

While the inertia bullet pullers and press-type bullet pullers are well known, the known devices utilize a complicated construction for jointly performing the operation of holding the bullet stationary while the cartridge casing is moved to separate the bullet from the cartridge casing or the cartridge casing is held stationary and force is applied to the bullet to remove it from the cartridge casing. The prior art devices have attempted to provide a bullet puller or extractor that is sufficiently versatile to permit disassembly of a range of bullet calibers, but these efforts have increased the complexity and associated expense to the reloader. Therefore, there is need to provide a bullet extractor that is operable for use with a conventional loading press that allows handling of a range of bullet calibers without a requiring modification to the basic loading press for hand disassembly or reloading of a cartridge without damaging the extracted bullet.

SUMMARY OF THE INVENTION

In accordance with the present invention, there is provided a bullet cartridge holder that includes an elongated body portion having an end portion. A bifurcated intermediate portion is formed integral with and extends from the end portion. A pair of arm members project from the bifurcated intermediate portion. The arm members are adjacently positioned in spaced relation to move toward and away from each other in response to a compressive force applied to the arm members. The retention means is positioned on the bifurcated intermediate portion for receiving and retaining bullet cartridges in a selected range of caliber sizes. The retention means extends longitudinally on the bifurcated intermediate portion between the end portion and the pair of arm members. The arm members are movably urged in a first direction toward one another when the arm members are compressed together to frictionally retain the bullet cartridge selectively positioned on the retention means. The arm members are movable in a second direction away from one another upon release of a compressive force to permit insertion and removal of a bullet cartridge on a retention means.

Further, in accordance with the present invention, there is provide an apparatus for extracting a bullet from a cartridge casing that includes a loading press having a base portion. Means is provided for stationarily positioning the base portion. A housing is supported by the base portion. A chuck is reciprocally positioned in the housing. The chuck includes means for receiving and securely retaining a cartridge casing having a bullet extending from the cartridge casing. An actuator means connected to the chuck reciprocally moves the chuck within the housing from a initial position on the base portion to a retracted position on the base portion. A bullet holder for frictionally engaging the bullet is movably positioned relative to the chuck. A brace is connected to the loading press base portion. The bullet holder is freely movable into and out of a supporting position on the brace to engage and disengage the bullet in the path of the reciprocal movement of the cartridge casing with the chuck. The chuck is movable relative to the bullet holder upon movement of the actuation means from the initial position to the retracted position to separate the cartridge casing from the bullet as the cartridge casing moves with the chuck in a direction away from the bullet being stationarily retained by the bullet holder on the brace.

Another feature of the present invention is directed to a method for extracting a bullet from a cartridge casing and includes the steps of positioning a cartridge casing in a first position in a reciprocally movable chuck. A bullet of the cartridge is securely positioned in a holder. A force is exerted on the chuck to move the chuck from the first position to a second position away from the fixed holder. The cartridge casing is separated from the bullet as the chuck moves from the first position to the second position. The bullet is retained stationary in the fixed holder as the cartridge casing moves with the chuck away from the fixed holder.

Accordingly, the principal object of the present invention is to provide a bullet extractor that is hand operable in combination with the loading press to extract a wide range of caliber of bullets from their associated cartridge casing in a manner easily movable into and out of position on a loading press.

Another object of the present invention is to provide a hand operable bullet holder that securely engages the bullet while a force is exerted on the cartridge casing to separate the cartridge casing from the bullet without damaging the bullet in the extraction operation.

A further object of the present invention is to provide a method and an apparatus for pulling bullets from the cartridge cases in bullet reloading operations that utilize a conventional loading press.

An additional object of the present invention is to provide a hand operable bullet holder and puller that is engagable and An additional object of the present invention is to provide a hand operable bullet holder and puller that is engagable and disengagable with the bullet in an efficient manner without damaging the bullet and requiring complex modification to a conventional loading press.

These and other objects of the present invention will be more completely disclosed and described in the following specification, accompanying drawings, and appended claims.

DESCRIPTION OF THE PREFERRED EMBODIMENTS

Figure 1:
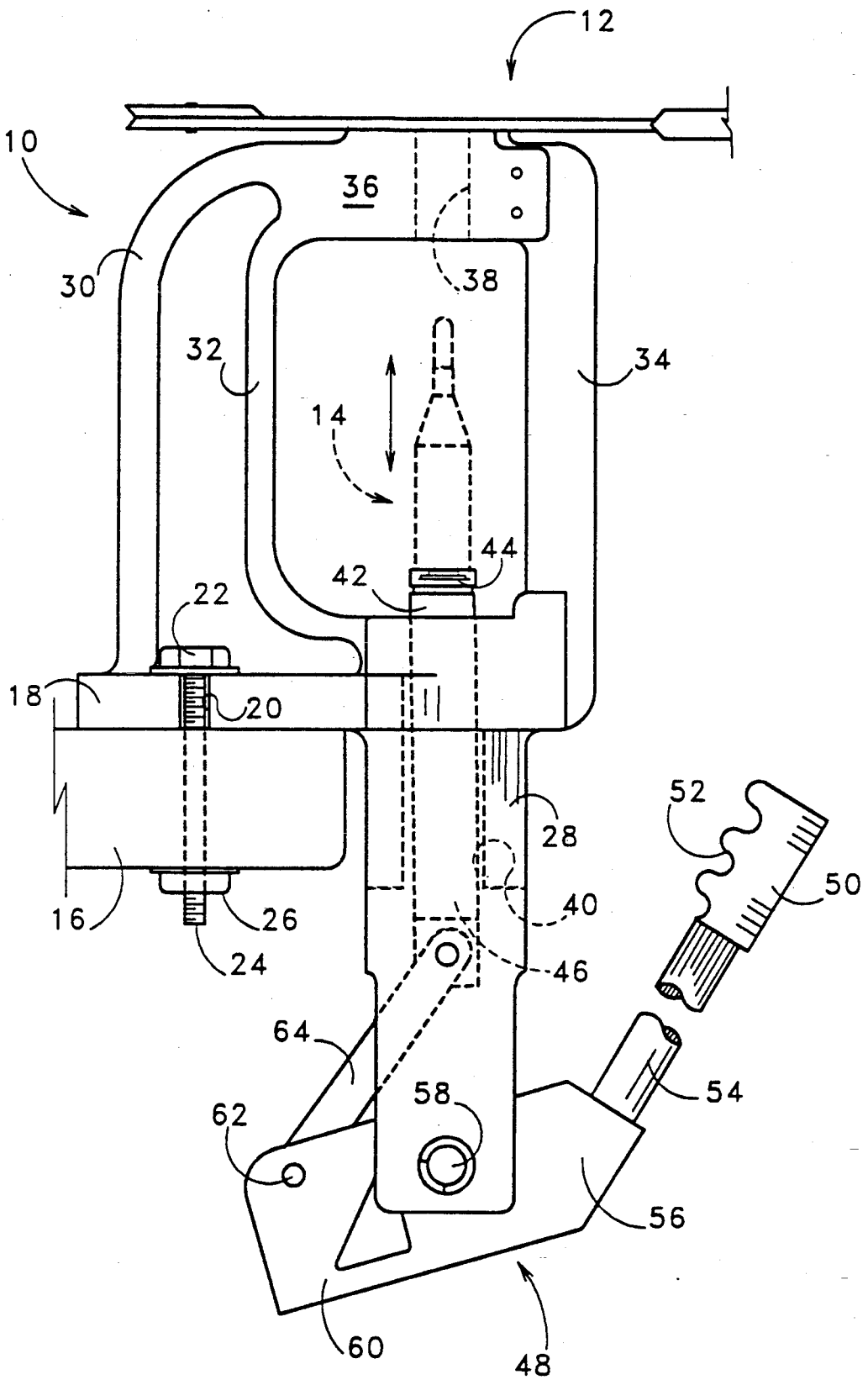
FIG. 1 is a view in side elevation of a conventional loading press used in bullet pulling and extracting operations with a bullet puller of the present invention supported by the press, illustrating in phantom the position of the cartridge in a chuck of the bullet press.

Referring to the drawings, and particularly FIGS. 1 and 5–7, there is illustrated a conventional loading press generally designated by the numeral 10 that is used in combination with a bullet extractor 12 in accordance with the present invention to separate the components of a cartridge case generally designated by the numeral 14 and illustrated in phantom in FIG. 1. The loading press 10 is conventional in design and, therefore, will not be described in detail herein.

As known in the art of bullet pulling or extracting the loading press 10 is securely mounted on a work bench 16 and includes a base portion 18 having a bore 20 for receiving a threaded bolt 22 that extends through the bore 20 aligned with a hole through the work bench 16. An end 24 of bolt 22 receives a nut 26 which is threadedly advanced on the bolt end portion 24 into engagement with the surface of the work bench 16 to securely mount the base portion 18 onto the work bench 16.

The base portion 18 of the loading press 10 is connected to a cylindrical housing 28 that is vertically positioned relative to the work bench 16. The base portion 18 and the housing 28 are integrally formed and extending up from the base portion 18 and the housing 28 are braces or support members 30, 32 and 34. The brace members 30–34 are connected at their upper end portions to a pedestal portion 36 of the loading press 10. The pedestal portion 36 includes a vertically extending bore 38 therethrough. The bore 38 is vertically aligned with a vertically extending bore 40 positioned in the cylindrical housing 28.

Figure 6:
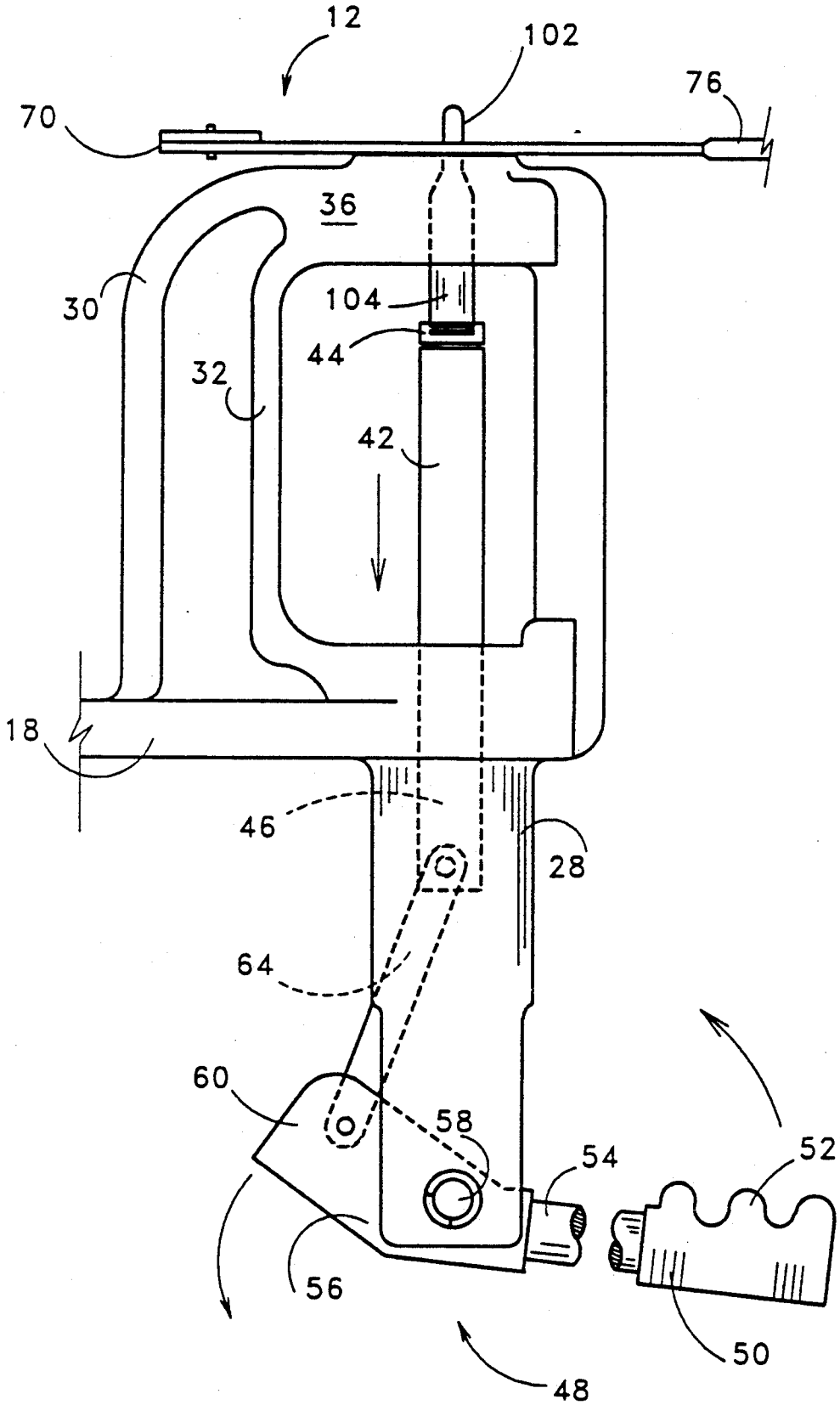
FIG. 6 is a view similar to FIG. 5, illustrating actuation of the loading press to commence downward movement of the cartridge casing relative to the bullet extractor stationarily positioned on the press.
Figure 7:
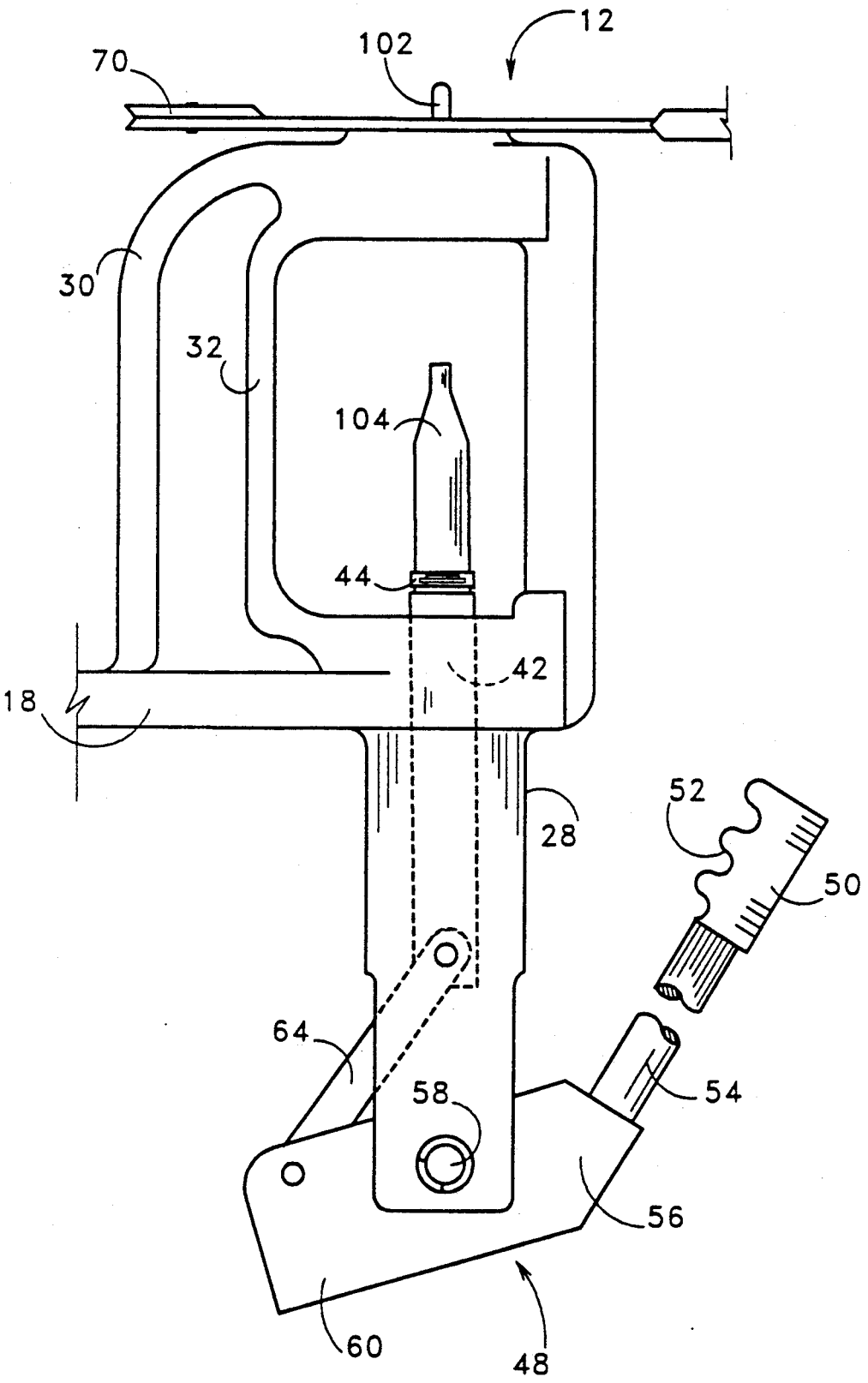
FIG. 7 is a view similar to FIG. 5, illustrating the cartridge casing moved on the press to a position separated from the bullet engaged by the bullet extractor.

A chuck 42 is retained for vertical reciprocal movement within the housing bore 40 and includes at an upper end portion movable jaws 44, the jaws 44 are engagable with the rim of the cartridge case, as well known in the art. The chuck 42 includes a lower end portion 46 positioned within the housing of bore 40. The chuck lower end portion 46 is connected to an actuator mechanism generally designated by the numeral 48. The actuator mechanism 48 includes a handle 50 having a grip portion 52. The handle 50 is connected by a lever 54 to a pivot housing 56 which is pivotally connected by a pin 58 to the lowermost portion of the cylindrical housing 28. With this arrangement, movement of the handle 50 in the direction as indicated in FIG. 6 pivots the housing 56 about the pin 58.

Figure 5:
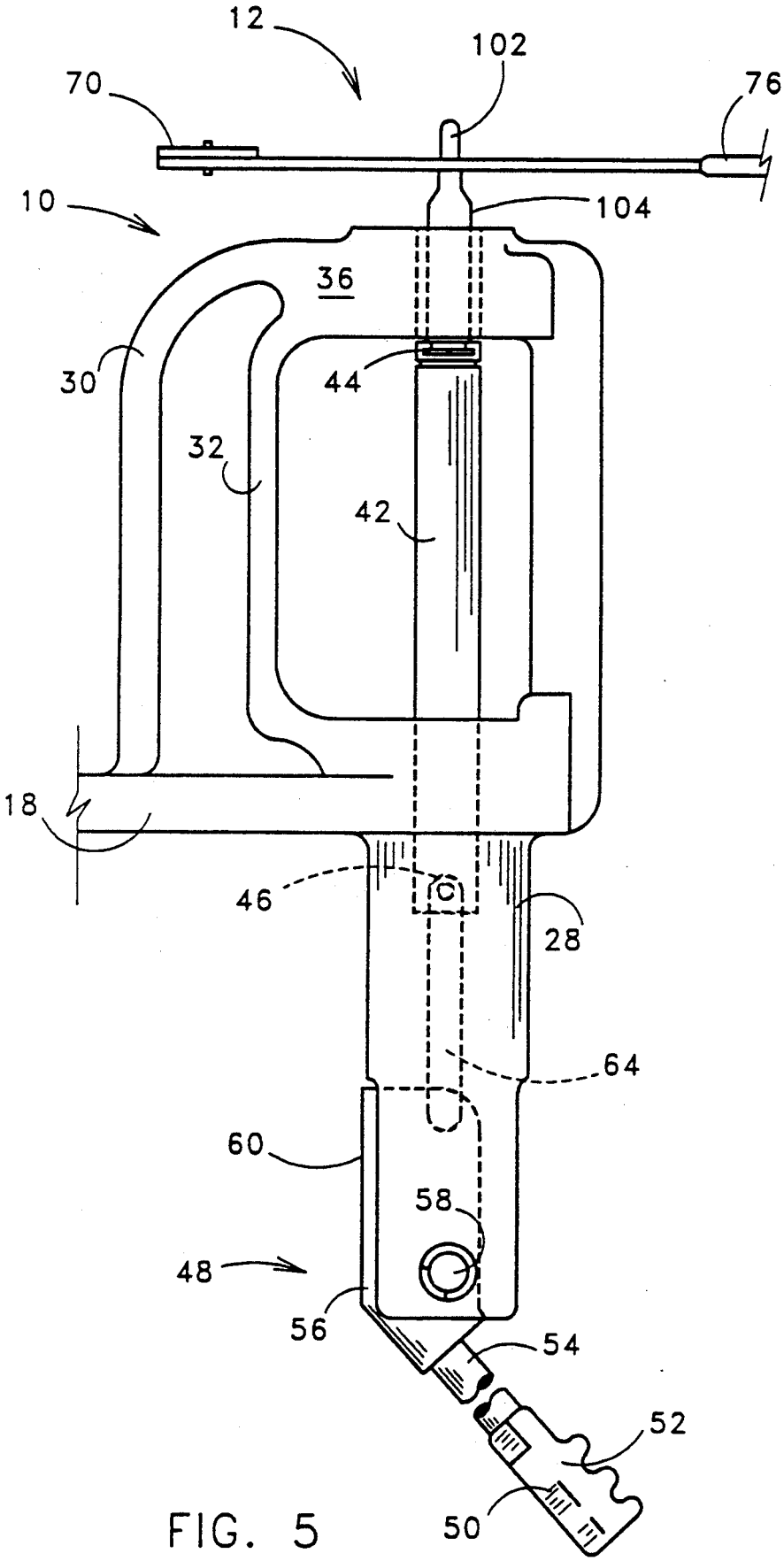
FIG. 5 is schematic view in side elevation of the loading press and bullet extractor in the initial position engaging a cartridge for extraction of the bullet from the cartridge casing.

The pivot housing 56 includes an opposite end portion 60 pivotally connected by a pin 62 to a link arm 64 which is in turn pivotally connected to the chuck lower end portion 46. Thus, by pivoting the handle 50 about the pivot pin 58 on the housing 28 the link arm 64 is moved, as illustrated in FIGS. 5 and 6, to raise and lower the chuck 42 relative to the loading press base portion 18. It should be understood that the lower end portion of the housing 28 adjacent the pivot pin 58 is open to expose the chuck lower end portion 46 to facilitate movement of the lever arm 64 and pivot housing 56 as shown in FIGS. 5 and 6. This operation of the loading press 10 is conventional and therefore requires no further description.

The cartridge case 14 is initially positioned in the chuck 42 as shown in FIG. 1. Once the jaws 44 of the chuck 42 securely engage the rim of the cartridge case, the cartridge is then ready for extraction from the bullet.

Figure 2:
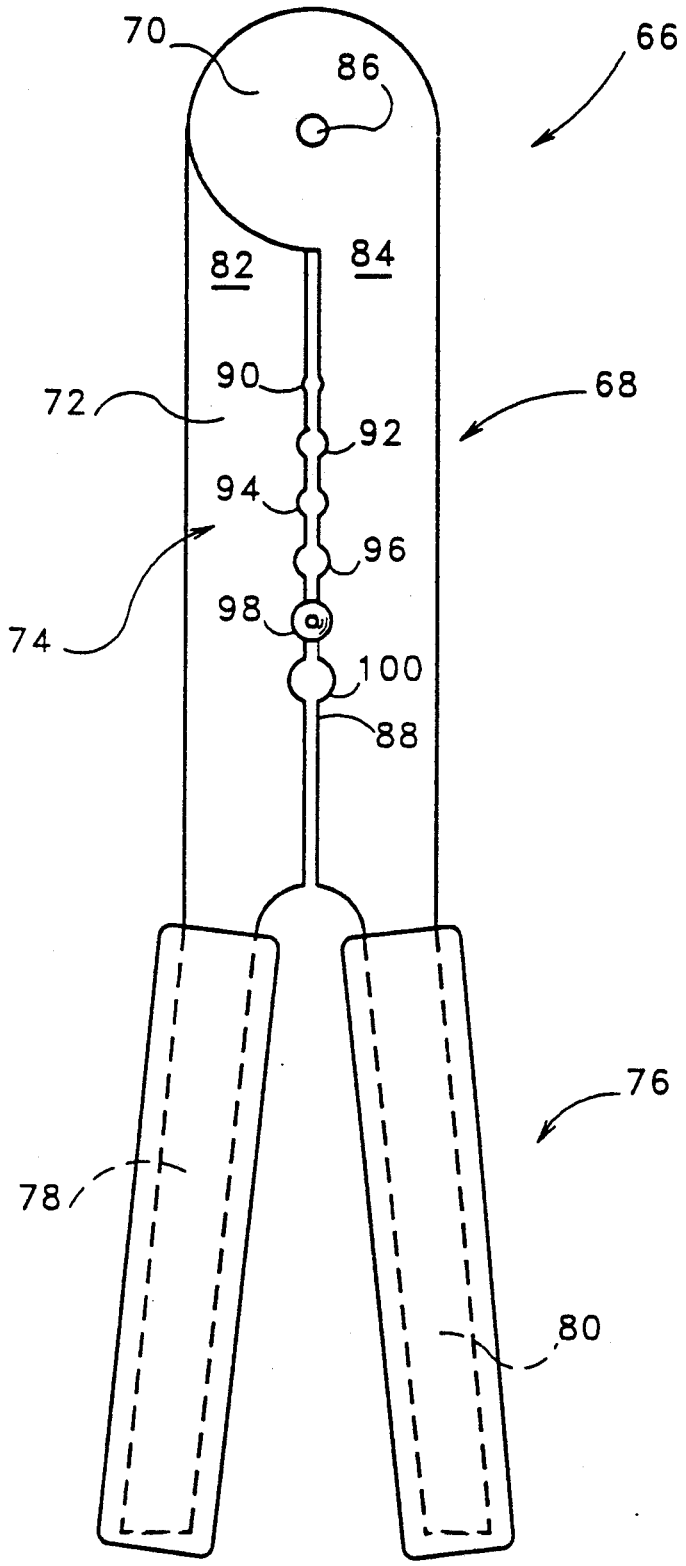
FIG. 2 is an enlarged plan view of one embodiment of the bullet extractor of the present invention.
Figure 3:
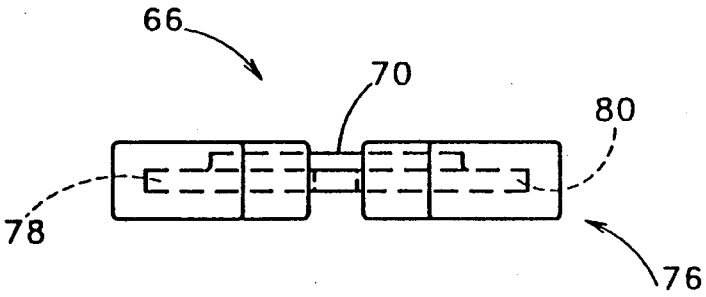
FIG. 3 is an end view of the bullet extractor, shown in FIG. 2.
Figure 4:
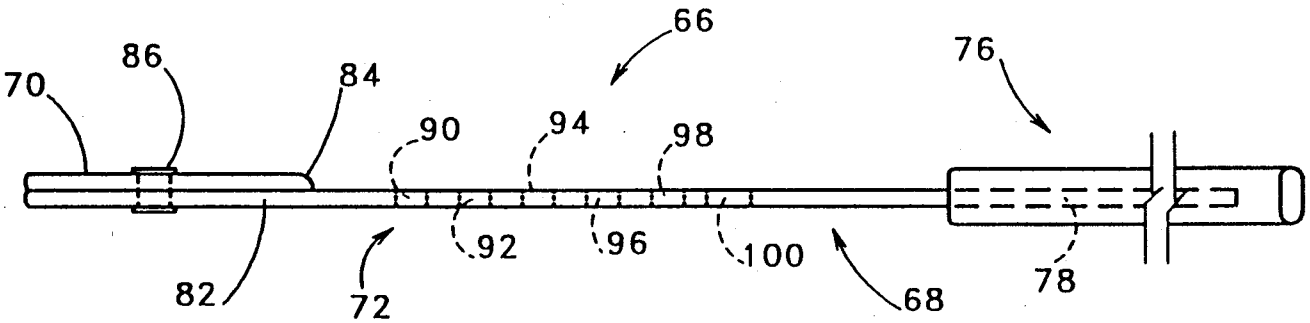
FIG. 4 ia fragmentary view in side elevation of the bullet extractor, shown in FIG. 2.

In accordance with the present invention the bullet extractor 12 is operable with the loading press 10 to engage the bullet and hold it stationary while the actuator mechanism 48 is operated to exert a force on the cartridge case upon downward movement of the chuck 42 with sufficient force to extract or separate the cartridge from the bullet. Now referring to FIGS. 2–4 there is illustrated a first embodiment of a bullet extractor or holder generally designated by the numeral 66 that includes an elongated body portion having an arcuate end portion 70 connected to a bifurcated intermediate portion 72 having a bullet receiving portion generally designated by the numeral 74. A grip portion 76 extends from the intermediate portion 72. Preferably the grip portion 76 is formed by a pair of arm members 78 and 80 which are movable in a pincer-type action toward and away from one another to open and close the bullet receiving portion 74 in a pivotal manner about the end portion 70. As seen in FIG. 2 the arm members 78 and 80 diverge outwardly to increase the spacing between the arm members from the bullet receiving portion 74 to the extreme ends of the arm members 78 and 80. The bullet receiving portion 74 is bifurcated, and therefore, movable with respective arm members 78 and 80 and thereby forms segments 82 and 84 which are pivotally connected in overlying relation at end portion 70 by pivot pin 86. With this arrangement by grasping the arm members 78 and 80, the segments 82 and 84 are movable toward and away from each other.

The segments 82 and 84 are spaced apart to form a channel 88 that extends longitudinally on the intermediate portion 72. Positioned in a spaced relation along the length of the intermediate portion 72 and opening into the channel 88 are a plurality of recesses formed in the segments 82 and 84. The recesses are positioned in pairs oppositely of one another to form substantially complete holes 90, 92, 94, 96, 98, and 100. Any number of holes may be formed in this manner of a preselected diameter or of same diameter. The diameter of the thus formed holes selected to correspond to the caliber of bullet to be extracted from the cartridge case. For example, the holes can be designed to accommodate bullet calibers of 0.224, 0.243, 0.257, 0.277, and 0.308 inches.

In operation the bullet extractor, such as the embodiment of the bullet extractor 66 shown in FIG. 2, is positioned horizontally on the pedestal portion of the loading press 10 as shown in FIG. 1. The bullet extractor 66 is positioned with the intermediate portion 72 overlying the bore 38 that extends through the pedestal portion 36. With the caliber of the bullet for the cartridge 14 known, one of the holes 90–100 corresponding to the bullet caliper is positioned over the bore 38 to receive the bullet with the cartridge case engaged by the chuck 42. Once the cartridge case has been securely engaged by the jaws 44 of the chuck 42, the handle 50 is pivoted downwardly from the position shown in FIG. 1 to the position shown in FIG. 5 to raise the chuck 42 to extend the cartridge through the bore 38 so that the bullet extends well above the pedestal 36. In this position of the cartridge case the bullet extractor is positioned to engage bullet 102 in a selected one of the holes 90–100.

Separating or moving the arm members 78 and 80 away from one another opens up the holes so that the bullet receiving portion 74 of the bullet extractor 66 can be positioned in surrounding relation with the bullet 102. The bullet 102 extends through the channel 88 between the recesses forming the respective holes the arm members 78 and 80 are squeezed together to firmly engage the bullet 102 by the bullet receiving portion 74 in one of the holes.

To initiate the bullet pulling operation the handle 50 of the loading press 10 is then pivoted about the pin 58 from the position illustrated in FIG. 5 to the position illustrated in FIG. 6. The chuck 42 is thus lowered together with the cartridge case 104 together with the bullet 102 until the bullet extractor 66 comes to rest on the pedestal 36, as shown in FIG. 6. Thereafter continued upward pivotal movement of the arm 50 urges the chuck 42 downward within the housing 28. As the chuck 42 moves downwardly the extractor 66 is held firmly in position on the pedestal 36. The bullet 102 is gripped with sufficient force to extract the bullet 102 from the cartridge case 104 upon continued downward movement of the chuck 42 to the position shown in FIG. 7. The bullet 102 is separated from the cartridge case 104 without damaging the bullet 102 for reuse. Once the extraction process is completed the bullet 102 is removed from the extractor 66. The cartridge 104 is then removed from the chuck 42 to permit reloading of the cartridge case 104.

Figure 8:
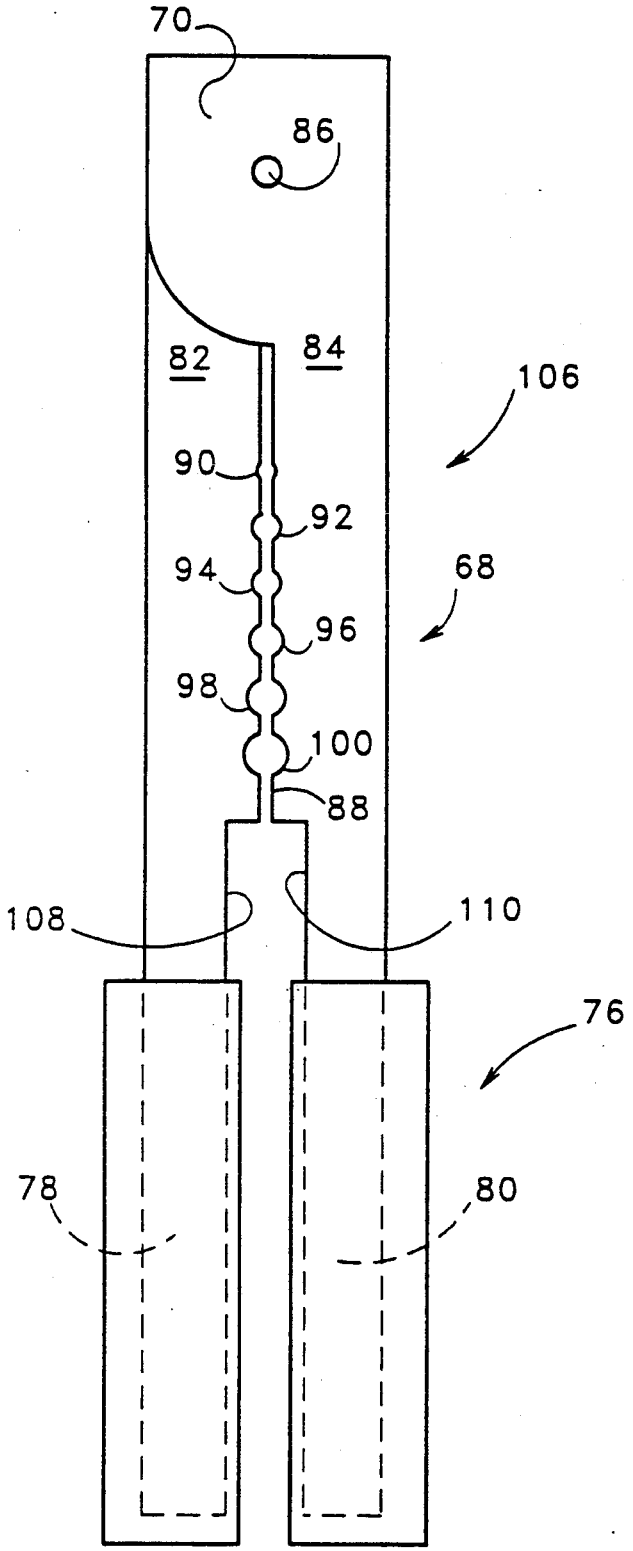
FIG. 8 is a view similar to FIG. 2, illustrating another embodiment of the bullet extractor of the present invention.
Figure 9:
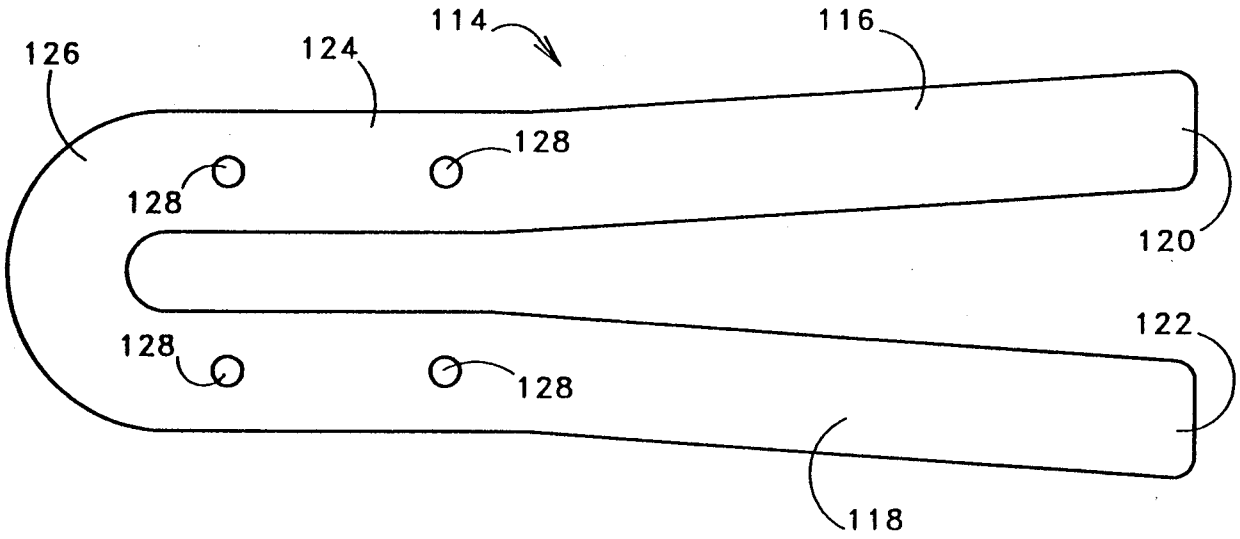
FIG. 9 is a plan view of a body portion of a third embodiment of a bullet extractor in accordance with the present invention.
Figure 10:
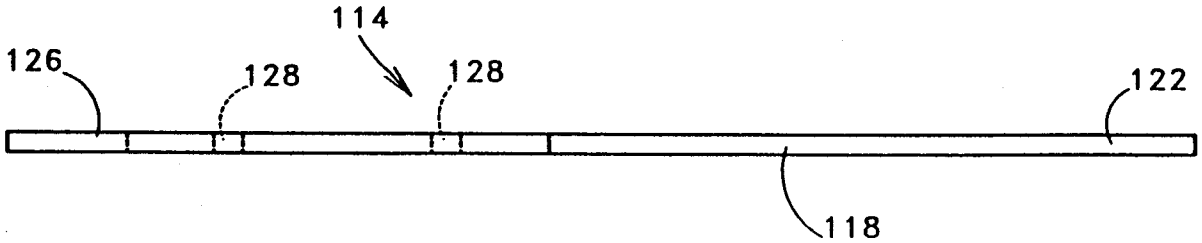
FIG. 10 is a view in side elevation of the bullet extractor body portion, shown in FIG. 9.

Now referring to FIG. 8 there is illustrated a further embodiment of the bullet extractor generally designated by the numeral 106 in which like elements shown in FIG. 2 are designated by like parts in FIG. 8. As above described the arm members 78 and 80 of the extractor 66 shown in FIG. 2 diverge outwardly. With the embodiment of the extractor 106 shown in FIG. 8, the arm members 78 and 80 extend in the spaced parallel relation by the provision of cut-out portions 108 and 110 provided at the interconnection of the handle 78 and 80 with the bullet receiving portion 74 of the extractor 106. The embodiment of the extractor 106 shown in FIG. 8 operates in an identical manner as the extractor 66 illustrated in FIG. 2 and described above.

Figure 11:
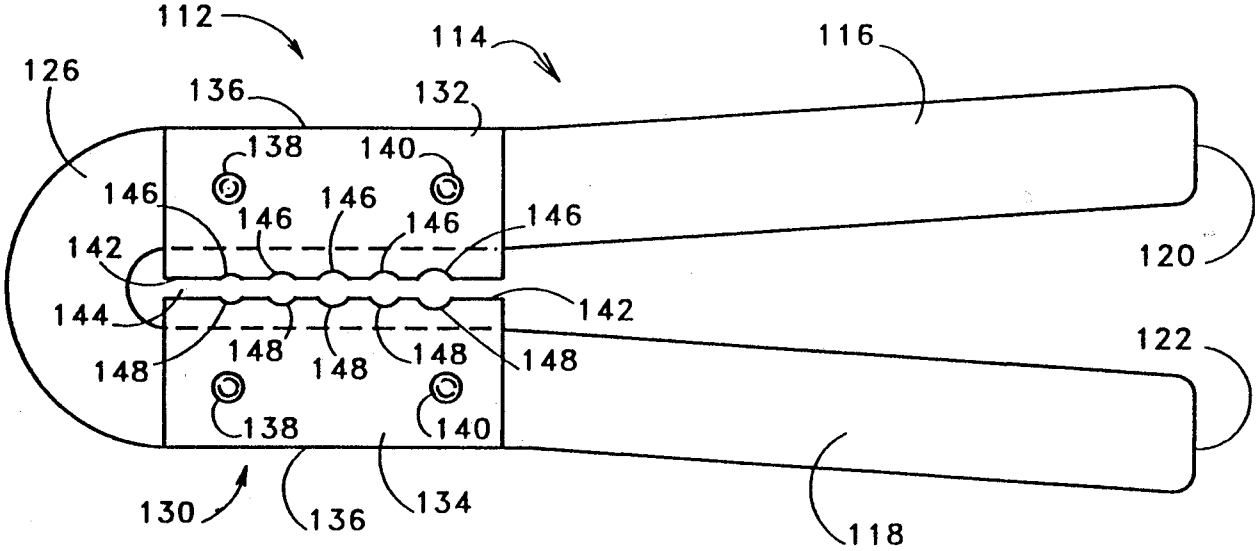
FIG. 11 is a top plan view of a bullet extractor utilizing the body portion, shown in FIG. 9.
Figure 12:
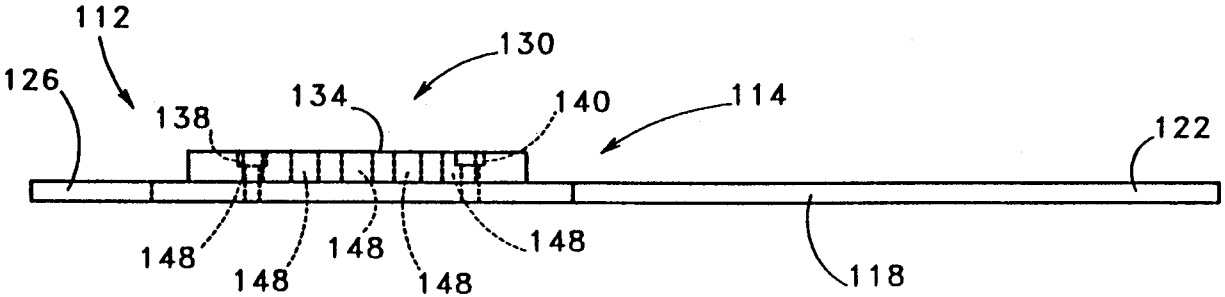
FIG. 12 is a view in side elevation of the bullet extractor, shown in FIG. 11.

Now referring to FIGS. 9–12 there is illustrated a third embodiment of the bullet extractor generally designated by the numeral 112 in FIG. 11. The bullet extractor 112 includes an elongated body portion generally designated by the numeral 114 in FIG. 9, having a pair of pincer-type arm members 116 and 118 with free end portions 120 and 122 respectively. Extending from and formed integrally with the arm members 116 and 118 is an intermediate portion 124 which extends to an end portion 126 of the extractor 112. The end portion 126 is formed integral with the arm members 116 and 118 which extend through the intermediate portion 124.

The intermediate portion 124 of the extractor body portion 114 is provided with a plurality of bores 128. Positioned on the intermediate portion 124 over the bores 128 is a bullet retention plate generally designated by the numeral 130 in FIG. 11. The bullet retention plate includes a pair of segments 132 and 134. The segments 132 and 134 are rectangular in shape and each include an outer edge 136 positioned in alignment with the outer edge of the extractor intermediate portion 124, shown in FIG. 11. Each of the segments 132 and 134 is provided with a pair of bores 138 and 140 which extend through the respective segments 132 and 134 into communication with the bores 128 to receive a conventional fastener (not shown). In this manner the segments 132 and 134 are securely connected to the extractor body portion 114.

Each of the segments 132 and 134 forming the bullet retention plate 130 of the embodiment of the extractor 112 shown in FIG. 11 includes oppositely positioned edges 142. The edges 142 are spaced apart to form a channel 144 separating the segments 132 and 134 on the body portion 114. The segment 132 includes a plurality of recesses 146 that extend from the edge 142 into the segment 132. The recesses 146 have a selected radius corresponding to the radius of bullets to be extracted. The recesses are spaced a suitable distance apart along the length of the edge 142. In a similar fashion the segment 134 includes a plurality of recesses 148 that extend from the edge 142 into the body of the segment 134. The recesses 146 and 148 are positioned oppositely of one another to form substantially a circular openings to receive the bullet. The caliber of the bullet is matched with the size of the hole formed by the respective recesses 146 and 148.

The embodiment of the extractor 112 shown in FIG. 11 is used in a substantially identical manner to embodiments of the extractors 66 and 106 described above and illustrated in FIGS. 2 and 8 and also as shown in FIGS. 1 and 5–7. The extractor 112 is positioned on the press pedestal portion 36 so that a selected one of the holes formed by the recesses 146 and 148 is positioned in overlying relation with the bore 38 to receive the bullet when it is raised by the chuck to the position shown in FIG. 5. Once the bullet has been positioned in a selected one of the holes, the arm members 116 and 118 are squeezed together to urge the arm members 116 and 118 into frictionally engagement with the bullet. Once the bullet has been firmly engaged, the extractor 112 is firmly held in place on the pedestal 36, as the loading press is operated to move the cartridge downwardly to separate the bullet from the cartridge case.

It should be understood that the above-described embodiments of extractors 66, 106, and 112 may be fabricated of selected materials. For example, they may be fabricated of plexiglass or high-impact styrene material. Furthermore, any arrangement and size of holes may be formed on the respective bullet receiving portion of the extractor. The holes may vary in diameter or be identical in diameter. This arrangement is selective with the user of the bullet extractor.

According to the provisions of the Patent Statutes, we have explained the principle, preferred construction and mode of operation of our invention and have illustrated and described what we now consider to represent its best embodiments. However, it should be understood, that within the scope of the appended claims, the invention may be practiced otherwise than as specifically illustrated and described.

We claim:

1. A bullet cartridge holder comprising, a bifurcated elongated body portion having a pair of pincer-type arm members integrally connected to and extending from an end portion, an intermediate portion provided on each of said arm members, said pair of arm members being adjacently positioned in spaced relation to move toward and away from each other in a pincer-type action in response to a compressive force applied to said arm members, a bullet retention plate extending longitudinally on said intermediate portion of each of said arm members, each of said retention plates including a longitudinal edge portion having a plurality of recesses positioned in spaced relation on said edge portion, said recesses of said retention plates being positioned oppositely of one another to form holes for receiving and retaining bullet cartridges in a selected range of caliber sizes, means for releasably connecting said retention plates to said arm members to provide on said arm members means for retaining bullet cartridges of a preselected range of caliber sizes where a first set of retention plates forming holes for a first range of caliber sizes is replaced on said arm members by a second set of said retention plates forming holes for a second range of caliber sizes, and said arm members being movable urged in a first direction toward one another when said arm members are compressed together to frictionally retain the bullet cartridge selectively positioned in one of said holes formed by said retention plates and said arm members movable in a second direction away from one another upon release of a compressive force to permit insertion and removal of a bullet cartridge from said retention plates.

2. A bullet cartridge holder as set forth in claim 1 wherein, said arm members extend angularly away from one another along the length thereof from said intermediate portion.

3. A bullet cartridge holder as set forth in claim 1 wherein, said arm members being pivotally connected at said body portion end portion to permit relative movement of said arm members toward and away from each other to engage and disengage a bullet cartridge by said retention plates.

4. A bullet cartridge holder as set forth in claim 1 wherein, said arm members each including a grip portion for holding said arm members and applying a force thereto to urge the arm members toward one another to frictionally engage a bullet cartridge on said retention plates.

5. A bullet cartridge holder as set forth in claim 1 which includes, said recesses forming said holes each having a preselected diameter, where the diameter of said holes increases from one hole to the next.

6. A bullet cartridge holder as set forth in claim 5 wherein, said recesses are equally spaced from one another and positioned in spaced longitudinal relationship on said retention plate.

7. A bullet cartridge holder as set forth in claim 1 which includes, means for integrally connecting said arm members at said body portion end portion to pivot relative to each other, and said arm members extending angularly from said end portion and terminating in a grip portion, such that said arm members diverge outwardly to increase the spacing between said arm members.

8. A bullet cartridge holder as set forth in claim 1 wherein, said retention plates being positioned on said arm members in spaced apart relation to form a channel between said retention plates, and said recesses extending into said channel to form substantially circular openings which are increased and decreased in size upon movement of said arm members toward and away one another.

9. A bullet cartridge holder as set forth in claim 8 wherein, said holes formed by said recesses progressively increase in diameter along the length of said retention plates.

10. A bullet cartridge holder comprising, a bifurcated elongated body portion having a pair of pincer-type arm members integrally connected to and extending from an end portion, an intermediate portion provided on each of said arm members, said pair of arm members being adjacently positioned in spaced relation to move toward and away from each other in a pincer-type action in response to a compressive force applied to said arm members, a bullet retention plate removably secured in overlying relation to said intermediate portion, said plate being formed in segments positioned on said arm members respectively, each of said segments including recesses positioned oppositely of one another to form holes of a preselected diameter for receiving bullet cartridges of a first preselected range of caliber sizes, said segments being replaceable on said arm members for another set of segments including recesses to form holes for receiving bullet cartridges of a second preselected range of caliber sizes, and said arm members being movably urged in a first direction toward one another when said arm members are compressed together to frictionally retain the bullet cartridge selectively positioned on said bullet retention plate and said arm members movable in a second direction away from one another upon release of a compressive force to permit insertion and removal of a bullet cartridge on said bullet retention plate.

11. A bullet cartridge holder as set forth in claim 10 wherein, said segments are positioned on said intermediate portion in spaced apart relation to form a channel between said segments, and said recesses extending into said channel to form substantially circular openings which are increased and decreased in size upon movement of said arm members toward and away one another.

12. A bullet cartridge holder as set forth in claim 11 wherein, said openings formed by said recesses progressively increase in diameter along the length of said retention plate.

13. A bullet cartridge holder comprising, a bifurcated elongated body portion having a pair of pincer-type arm members integrally connected to and extending from an end portion, an intermediate portion provided on each of said arm members, said pair of arm members being adjacently positioned in spaced relation to move toward and away from each other in a pincer-type action in response to a compressive force applied to said arm members, a pair of segments releasably connected to said intermediate portion and spaced apart to form a channel between said segments, a plurality of recesses on said segments extending into said channel to form substantially circular openings which are increased and decreased in size upon movement of said arm members toward and away from one another, said segments having a first preselected range of diameters for receiving bullet cartridges of a corresponding range of caliber sizes, said segments being replaceable on said arm members for another set of segments including recesses to form openings for receiving bullet cartridges of a second preselected range of caliber sizes, and said arm members being movably urged in a first direction toward one another when said arm members are compressed together to frictionally retain the bullet cartridge selectively positioned on said segments and said arm members movable in a second direction away from one another upon release of a compressive force to permit insertion and removal of a bullet cartridge on said segments.

* * * * *